United States Patent [19]

Sliwka

[11] 4,420,343

[45] Dec. 13, 1983

[54] PROCESS FOR THE THERMAL DECOKING OF CRACKED GAS COOLERS

[75] Inventor: Artur Sliwka, Kirchheim, Fed. Rep. of Germany

[73] Assignee: BASF Aktiengesellschaft, Fed. Rep. of Germany

[21] Appl. No.: 237,963

[22] Filed: Feb. 25, 1981

[51] Int. Cl.[3] ..... B08B 9/02

[52] U.S. Cl. ..... 134/22.15; 134/30; 134/39; 165/95

[58] Field of Search ..... 134/2, 20, 30, 39, 22.11, 134/22.15; 122/379; 165/95; 196/122; 208/48 R

[56] References Cited

U.S. PATENT DOCUMENTS

| | | | |
|---|---|---|---|
| 2,057,441 | 10/1936 | McAllister | 208/48 R |
| 2,289,350 | 7/1942 | Dixon et al. | 196/69 |
| 2,289,351 | 7/1942 | Dixon et al. | 134/22.15 |
| 2,577,254 | 12/1951 | Lawson | 165/95 |
| 2,671,741 | 3/1954 | Duvall | 134/2 |
| 3,507,929 | 4/1970 | Happel et al. | 134/2 |
| 3,532,542 | 10/1970 | Shimizu et al. | 134/2 |
| 3,557,241 | 1/1971 | Kivlen et al. | 260/683 |
| 3,570,458 | 3/1971 | Sato et al. | 122/34 |
| 3,764,634 | 10/1973 | Ozawa et al. | 208/48 R |

FOREIGN PATENT DOCUMENTS

| | | | |
|---|---|---|---|
| 1948635 | 7/1970 | Fed. Rep. of Germany . | |
| 1926495 | 12/1972 | Fed. Rep. of Germany . | |
| 2645919 | 4/1978 | Fed. Rep. of Germany | 208/48 R |
| 1532127 | 7/1967 | France . | |
| 897396 | 5/1962 | United Kingdom | 134/2 |

*Primary Examiner*—William F. Smith

*Attorney, Agent, or Firm*—Keil & Witherspoon

[57] ABSTRACT

A process for the thermal decoking of cracked gas coolers for the indirect cooling, by means of water, of ethylene-containing cracked gases which are obtained by thermal cracking of hydrocarbons in the presence of steam in an indirectly heated tube cracking furnace, at cracked gas exit temperature of above 750° C., in which, instead of a heated steam/air mixture, heated air, without steam, is passed through the cracked gas cooled tubes which are to be decoked.

2 Claims, No Drawings

PROCESS FOR THE THERMAL DECOKING OF CRACKED GAS COOLERS

The present invention relates to a process for the thermal decoking of cracked gas coolers for the indirect cooling, by means of water, of ethylene-containing cracked gases which are obtained by thermal cracking of hydrocarbons in the presence of steam in an indirectly heated tube cracking furnace.

The thermal cracking of hydrocarbons in the presence of steam in an indirectly heated tube cracking furnace is extensively used in ethylene plants employing steam crackers in which, in addition to ethylene, other valuable unsaturated compounds, such as propylene and butadiene, as well as pyrolysis gasoline having a high content of aromatic hydrocarbons, eg. benzene, toluene and xylene, are obtained. The continued development of the process has led to progressively shorter residence times in the cracking tubes of the furnace, and to progressively higher cracking temperatures. In the modern processes, the preferred conditions employed are residence times of from 0.1 to 0.5 second for the hydrocarbons in the cracking tubes of the furnace and exit temperatures of the cracked gases, from the cracking tubes, in excess of 750° C., as a rule from 800° to 900° C. Under these extreme conditions, the cracked gas must be cooled immediately after leaving the tube cracking furnace, so as to prevent undesired side-reactions, which reduce the yield of valuable products. Such cooling can be effected by direct methods, in which liquid hydrocarbons or water are injected into the hot cracked gas. However, direct cooling has the disadvantage that when recovering the heat in the form of steam, the steam obtained is only at a low pressure. In general, it is therefore preferred to cool the cracked gases indirectly by passing them through a cracked gas cooler in which the gases are cooled by indirect heat exchange with water. This generates high-pressure steam, the pressure being up to 150 bar, preferably up to 130 bar. The high-pressure steam contributes to the economy of the process, since it provides the greater part of the drive energy required for the crude gas compressors and refrigeration compressors of the ethylene plant.

Though the thermal cracking of hydrocarbons in the presence of steam has reached a high technical level, the process suffers from a substantial disadvantage, namely the deposition of coke on the inner walls of the cracking tubes in the furnace, and the inner walls of the inlet cones and cooling tubes in the downstream cracked gas cooler. The insulating action of the coke raises the wall temperature of the cracking tubes of the furnace, and the pressure loss also increases. In the downstream cracked gas cooler, the deposit of coke reduces heat transfer, so that the temperature of the cracked gas exiting from the cooler rises. When the deposits of coke have reached a certain thickness, the tube cracking furnace and the downstream cracked gas cooler must be taken out of commission and decoked. The cracking tubes are as a rule decoked with a steam/air mixture or with steam alone or with a steam/hydrogen mixture (cf. German Laid-Open Application DOS 1,948,635) at temperatures of from 700° C. to 1,000° C.

There are several possible ways of cleaning a coked-up cracked gas cooler. In a first method, the cooler is cleaned mechanically. This method is very expensive and requires lengthy shut-down of the tube cracking furnace and a corresponding loss in production from the ethylene plant. To carry out such mechanical cleaning, the tube cracking furnace is as a rule cooled. When it has been cooled, the cracked gas cooler is opened and the individual tubes of the cooler, which may, for example, number more than 50, are decoked by mechanical cleaning, for example with a high-pressure water instrument, under a water pressure of, as a rule from 300 to 700 bar, or, in the case of very hard coke deposits, by means of water/sandblasting. A great disadvantage of this method is that the frequent cooling and subsequent heating up excessively stresses the furnace material and as a result frequently causes damage.

In a further method, the procedure described above is modified by first cooling the tube cracking furnace to 200°-400° C., then disconnecting the cracked gas cooler from the tube cracking furnace, and cleaning the completely cooled cracked gas cooler mechanically whilst at the same time decoking the cracking tubes of the furnace by means of a steam/air mixture. However, even in this case there is only a slight gain of time, particularly since the temperature change and the stressing of the cracking tubes of the furnace can cause coke to detach from the inside of the cracking tubes and thereby cause additional problems.

Further, attempts have been made to avoid cooling the tube cracking furnace and mechanically cleaning the cracked gas cooler, by employing a special design of cooler (German Published Application DAS No. 1,926,495). The cooling tubes are arranged spirally in this cooler and are made of an expensive heat-resistant material. To clean the cooler, the water must be drained from it, so that the coke can then be burnt off with a steam/air mixture. However, this method has also not found acceptance in industry, because of the extreme stresses to which it exposes the material, and the resulting frequency with which repairs are needed.

Finally, on-line decoking of tube cracking furnaces and cracked gas coolers has been disclosed (CZ-Chemie-Technik, 3 (1974), No. 2, 53, left-hand column, item 2.5); in this method, when carrying out conventional decoking of the cracking tubes of the tube cracking furnace by means of a steam/air mixture, the decoking gases are passed through the downstream cracked gas cooler in order to decoke the latter at the same time. In this method, the tube cracking furnace is taken out of commission earlier than necessary, before the maximum permissible exit temperature of the cracked gas from the cooler is reached. After decoking of the cracking tubes of the furnace has been completed, the coke in the cracked gas cooler has only been removed to a slight extent, because of the lower temperatures which obtain in on-line decoking in the cracked gas cooler. Against the advantage that the cracking furnace does not have to be cooled and the cones of the cracked gas cooler do not have to be dismantled, there is the disadvantage that the exit temperature of the cracked gas from the cooler does not drop to the level achieved after mechanical cleaning, but is only slightly lower than before shut-down, so that a correspondingly lower amount of high-pressure steam is generated in the cracked gas cooler. Furthermore, not later than after the third on-line cleaning, mechanical cleaning of the cracked gas cooler, with all the disadvantages which have been described, does after all become necessary.

It is an object of the present invention to provide a process for the thermal decoking of cracked gas coolers for the indirect cooling, by means of water, of ethylene-containing cracked gases obtained from a tube cracking furnace, in which the cracked gas cooler can be decoked thermally without additional mechanical cleaning of the cracked gas cooler, and the associated cooling of the upstream tube cracking furnaces, becoming necessary.

I have found that this object is achieved, according to the invention, and other advantages are attained, by a process for the thermal decoking of cracked gas coolers for the indirect cooling, by means of water, of ethylene-containing cracked gases which are obtained by thermal cracking of hydrocarbons in the presence of steam in an indirectly heated tube cracking furnace, at cracked gas exit temperatures of above 750° C., wherein, instead of a heated steam/air mixture, heated air, without introduction of steam, is passed through the cracked gas cooler tubes which are to be decoked.

In the novel process, the cracked gas coolers can be decoked thermally without necessitating an additional mechanical cleaning of the coolers and the cooling of the upstream tube cracking furnaces which this would entail. Whilst when using the conventional processes, for example the on-line decoking described above, the achievable annual percentage utilization of the furnaces is only 85–95%, figures of more than 97%, and accordingly correspondingly higher production of ethylene, are achievable with the process according to the invention, as a result of a reduction in the down time. At the same time, because of the increased utilization, fewer standby cracking furnaces are required in the ethylene plant, thereby reducing the investment costs of the plant. Furthermore, since there is no longer a cooling-down and heating-up period, the life of the cracking tubes of the furnace is increased. Further advantages of the process according to the invention are that the generation of high-pressure steam in the cracked gas cooler continues uninterrupted over the entire decoking process and that the operating costs of the decoking operation are reduced.

Using the process according to the invention, cracked gas coolers which are used for the indirect water cooling of ethylene-containing cracked gases are decoked thermally, the cracked gases being obtained by thermal cracking of hydrocarbons in the presence of steam in an indirectly heated tube cracking furnace, with gas exit temperatures of above 750° C. Suitable starting hydrocarbons for the thermal cracking process are ethane, propane, butane, liquefied petroleum gas, gasoline fractions, such as light naphtha, for example of boiling range from about 30° to 150° C., full-range naphtha, for example of boiling range from about 30° to 180° C., heavy naphtha, for example of boiling range from about 150° to 220° C., kerosene, for example of boiling range from about 200° to 260° C., gas oils, eg. light gas oil, for example of boiling range from about 200° to 360° C., and heavy gas oil, for example of boiling range from about 310° to 430° C., and vacuum distillates. The process is preferably used for cracked gas coolers employed to cool cracked gases which have been obtained from gasoline fractions, kerosene and/or gas oils. The exit temperatures of the cracked gas from the tube cracking furnace are above 750° C., preferably from 780° to 900° C., especially from 800° to 900° C. The residence times in the furnaces are in general from 0.05 to 1 second, preferably from 0.1 to 0.6 second, especially from 0.1 to 0.5 second.

Advantageously, the heat supplied to the cracking tubes in the furnaces is from 40,000 to 80,000 kcal/m$^2$.h, preferably from 50,000 to 70,000 kcal/m$^2$.h. In the thermal cracking process, the weight ratio of steam to hydrocarbon employed is in general from 0.1 to 1, preferably from 0.2 to 0.8, especially from 0.3 to 0.7.

Using the process according to the invention, the cracked gas cooler is thermally decoked by passing heated air, without added steam, through it. It is furthermore possible to accelerate the decoking by employing heated mixtures of air and oxygen instead of heated air. If such mixtures are used, the volume ratio of air to oxygen is in general from 100:1 to 1:100, preferably from 100:1 to 1:50, especially from 100:1 to 1:10. However, because of ready availability, heated air alone, without added oxygen, will as a rule be used for decoking.

The heated air or air/oxygen mixture in general enters the cracked gas cooler at from 600° to 1,100° C., preferably from 700° to 1,050° C., especially from 800° to 1,000° C.

The decoking can be carried out under slightly reduced pressure in the cracked gas cooler, for example at from 0.5 to 1 bar. In general, atmospheric pressure or superatmospheric pressure is employed in the cooler, advantageously from 1 to 50 bar, preferably from 1 to 20 bar, especially from 1 to 10 bar. Because of technical simplicity, it can be advantageous to operate at atmospheric pressure, though it may also be appropriate to employ superatmospheric pressure, namely from 2 to 50 bar, preferably from 5 to 40 bar.

In thermal decoking of the cracked gas cooler, a steam pressure of 80–160 bar, preferably of 90–150 bar, especially of 100–130 bar, is maintained on the boiling water side of the cracked gas cooler. As a rule, the ratio of the hourly weight throughput of heated air or heated air/oxygen mixture during thermal decoking, to the hourly throughput of hydrocarbon during thermal cracking is from 0.05 to 5, preferably from 0.1 to 3, especially from 0.1 to 2. In general, the cracked gas cooler is decoked until the exit temperature of the cracked gas from the cooler corresponds to the initial value of the exit temperature when the cooler is first put into operation, or after mechanical cleaning of the cooler.

As a rule, the cracked gas cooler is completely free from coke after about 20–30 hours' treatment, according to the invention, with air or an air/oxygen mixture, and if then put back into operation exhibits the above initial value of the cracked gas exit temperature. The course and completion of the decoking process can be followed in a simple manner by determining the carbon dioxide concentration in the gas mixture introduced into the cracked gas cooler and leaving it.

It is surprising that cracked gas coolers can be decoked completely by the process according to the invention, since all attempts to free such a cooler completely from coke by means of a steam/air mixture have failed. Even experiments on a laboratory scale, in which coke of the type formed in a cracked gas cooler was treated with air at the temperatures prevailing in such a cooler had shown that there was virtually no reaction between the coke and the air.

The air or air/oxygen mixture can be heated to the cracked gas cooler entry temperatures in a separate furnace, circumventing the tube cracking furnace or furnaces appertaining to the cooler, and can then be passed through the cooler. Preferably, however, the air or air/oxygen mixture is heated to the cracked gas cooler entry temperature in the corresponding tube cracking furnaces and then passed through the downstream cooler.

In a preferred embodiment of the process, the cracking tubes of the upstream tube cracking furnace are decoked before thermally decoking the cracked gas cooler. This is done advantageously by stopping the introduction of the hydrocarbon to be cracked, and passing a steam/air mixture through the indirectly heated cracking tubes of the furnace and at the same time through the downstream cracked gas cooler and, after completion of decoking of the cracking tubes of the furnace, stopping the supply of steam and thereafter only passing in air, or an air/oxygen mixture, through the indirectly heated cracking tubes of the tube cracking furnace and through the downstream cracked gas cooler. If the steam/air mixture is passed simultaneously through the furnace and through the downstream cooler, the exit temperatures generally employed for the gas mixture leaving the furnace are from 600° to 1,100° C., preferably from 700° to 1,050° C., especially from 700° to 900° C. In the steam/air mixture employed, the weight ratio of steam to air is advantageously from 100:1 to 2:8, preferably from 9:1 to 3:7, the process advantageously being started with a steam/air mixture having a very low air content, for example less than 10% by weight, or with steam alone, and increasing amounts of air then being admixed, for example up to 70% by weight of air in the steam/air mixture.

The Examples which follow illustrate the invention.

COMPARATIVE EXAMPLE

A tube cracking furnace with four cracking tubes is employed and through each tube a mixture of 2.2 t/h of a gasoline fraction (naphtha) of boiling range 40°–180° C., and 1.05 t/h of steam are passed and cracked, the furnace exit temperature being 850° C. The cracked gas from a pair of cracking tubes is cooled in one downstream cracked gas cooler. Initially, whilst the cooler is clean, the cooler exit temperature is 350° C. After several months' running, this temperature ultimately rises to 450° C., which is the maximum permissible cooler exit temperature. The stream of hydrocarbon through the furnace is then stopped and the cracking tubes and cracked gas cooler are decoked in a conventional manner, by passing a steam/air mixture through the tubes and through the downstream cooler. For this purpose, initially 1.0 t/h of steam and 0.08 t/h of air are passed through each cracking tube. The throughput of air is increased slowly over 10 hours, and the throughput of steam reduced, until ultimately a steam/air mixture containing 70% by volume of air is passed through each cracking tube. This condition is maintained for a further 6 hours, so that the total decoking process lasts 16 hours.

If the tube cracking furnace is cooled after this decoking and examined visually, it is found that the cracking tubes up to the inlet of the cracked gas cooler are completely clean, but not the tubes in the cooler itself, which shows a heavy deposit of coke, especially toward the exit. If the furnace is put back into operation under the initially stated conditions, the cracked gas cooler exit temperature proves to be 420°–430° C. In the prior art, the only way of achieving a cooler exit temperature of 350° C. was to clean the cooler mechanically.

EXAMPLE 1

The tube cracking furnace is initially operated, as described in the first paragraph of the Comparative Example, so as to produce the cracked gas, naphtha and steam being introduced, and when the maximum permissible cracked gas cooler exit temperature of 450° C. is reached, the decoking process also described in the first paragraph of the Comparative Example is carried out for 16 hours. The throughput of steam is then stopped completely and only air, in an amount of 1.3 t/h per cracking tube, is passed through. This corresponds to a weight ratio of air passed through per hour per cracking tube to hydrocarbon passed through per hour during thermal cracking, of 0.59. During this stage, the furnace exit temperature is kept at 850° C. Air is passed through for 30 hours, during which time the cracked gas cooler exit temperature assumes a value of 335° C., and high-pressure steam at 125 bar continues to be generated. After the 16 hours of steam/air decoking of the cracking tubes and the subsequent 30 hours' thermal treatment of the cracked gas cooler with air alone, the tube cracking furnace is put back into operation, without having cooled, by again passing 2.2 t/h of naphtha and 1.05 t/h of steam through each cracking tube.

EXAMPLE 2

In a tube cracking furnace, 2.2 t/h of gas oil and 1.7 t/h of steam are cracked per tube, the furnace exit temperature being 830° C. While the cracked gas cooler is clean, its exit temperature is 550° C., and the steam pressure on the water side is 125 bar. After several weeks' operation, the cracked gas cooler exit temperature rises to 650° C., the maximum permissible value. The stream of hydrocarbon is then stopped and, following the method described in Example 1 and in the Comparative Example, a mixture of steam and air, with slowly increasing air content (up to 70% by volume of air) is next passed through the cracking tubes and the downstream cracked gas cooler. After a decoking time of 16 hours, the cracking tubes of the furnace are completely clean, whilst only slight cleaning of the cracked gas cooler has occurred. Thereafter, using the method described in Example 2, air alone, without added steam, is first heated by passing through the cracking tubes of the furnace and then passed through the cracked gas cooler. 15–20 hours' passage of air suffices to achieve complete removal of coke from the cracked gas cooler, so that on putting the tube cracking furnace back into operation by introducing gas oil and steam, the temperature of the cracked gas exiting from the cracked gas cooler again assumes a value of 550° C., corresponding to that of a mechanically cleaned cooler.

I claim:

1. A process for the thermal decoking of cracked gas coolers for the indirect cooling, by means of water, of ethylene-containing cracked gases which are obtained by thermal cracking of hydrocarbons in the presence of steam in an indirectly heated tube cracking furnace at cracked gas exit temperatures of above 750° C., which process comprises: stopping the introduction of the hydrocarbon to be cracked to the cracking furnace, and passing a steam/air mixture through the indirectly heated cracking tubes of the furnace and at the same time through the downstream cracked gas cooler and, after completion of decoking of the cracking tubes of the furnace, stopping the supply of steam and thereafter passing only heated air or an air/oxygen mixture through the indirectly heated cracking tubes of the tube cracking furnace in such an amount that the ratio of the hourly weight throughput of heated air or heated air/oxygen mixture to the hourly throughput of hydrocarbon during thermal cracking is from 0.1 to 3, such air or air/oxygen mixture being heated to temperatures of from 600°to 1,100° C. and passing the heated air or air/oxygen mixture through the cracked gas cooler tubes which are to be decoked for a sufficient period to substantially decoke said cooler tubes and maintaining at the same time a steam pressure of at least 90 bar on the boiling water side of the cracked gas cooler.

2. The process of claim 1, wherein the cracked gas cooler is decoked to the point that the exit temperature of the cracked gas from the cooler corresponds to the initial value of the exit temperature when the cooler is first put into operation, or is put into operation after mechanical cleaning of the cooler.

* * * * *

UNITED STATES PATENT AND TRADEMARK OFFICE

CERTIFICATE OF CORRECTION

PATENT NO. : 4,420,343

DATED : December 13, 1983

INVENTOR(S) : Arthur Sliwka

It is certified that error appears in the above-identified patent and that said Letters Patent is hereby corrected as shown below:

IN THE TITLE PAGE:

Please add the following:

[30] Foreign Application Priority Data

March 15, 1980 [DE] Fed. Rep. of Germany....3010000

Signed and Sealed this

*Twentieth* Day of *March 1984*

[SEAL]

*Attest:*

GERALD J. MOSSINGHOFF

*Attesting Officer*

*Commissioner of Patents and Trademarks*